US010538977B1

(12) United States Patent
LaValley

(10) Patent No.: US 10,538,977 B1
(45) Date of Patent: Jan. 21, 2020

(54) PIPE MAKE/BREAK VISE ASSEMBLY WITH PIPE JOINT HEATER

(71) Applicant: LaValley Industries, LLC, Bemidji, MN (US)

(72) Inventor: Jason LaValley, Bemidji, MN (US)

(73) Assignee: LAVALLEY INDUSTRIES, LLC, Bemidji, MN (US)

( * ) Notice: Subject to any disclaimer, the term of this patent is extended or adjusted under 35 U.S.C. 154(b) by 0 days.

(21) Appl. No.: 16/108,912

(22) Filed: Aug. 22, 2018

(51) Int. Cl.

| | |
|---|---|
| ***E21B 19/16*** | (2006.01) |
| ***B66C 1/42*** | (2006.01) |
| ***E21B 7/02*** | (2006.01) |
| ***E21B 7/04*** | (2006.01) |
| ***B66C 3/00*** | (2006.01) |

(52) U.S. Cl.
CPC ..... *E21B 19/163* (2013.01); *B66C 1/427* (2013.01); *B66C 3/005* (2013.01); *E21B 7/022* (2013.01); *E21B 7/046* (2013.01)

(58) Field of Classification Search
CPC combination set(s) only.
See application file for complete search history.

(56) References Cited

U.S. PATENT DOCUMENTS 1,401,405 A * 12/1921 Hole ..... E21B 19/16 173/164
1,615,695 A * 1/1927 Grattan ..... E21B 19/16 166/77.51
4,133,095 A * 1/1979 Lewis ..... E21B 17/006 29/458
8,490,519 B2 7/2013 LaValley et al.
2003/0132030 A1* 7/2003 Tompkins ..... E21B 19/164 175/52
2016/0160588 A1 6/2016 LaValley et al.
2017/0342816 A1 11/2017 LaValley et al.

OTHER PUBLICATIONS

CRC-EVANS: "Induction Heat Treatment", Website;https://www.crc-evans.com/onshore/services/induction-heat-treatment, Retreived: Jun. 12, 2019; in existence on or before Aug. 22, 2018; 4 pages.

* cited by examiner

*Primary Examiner* — Taras P Bemko
*Assistant Examiner* — Ronald R Runyan
(74) *Attorney, Agent, or Firm* — Hamre, Schumann, Mueller & Larson, P.C.

(57) ABSTRACT

Systems, apparatus and methods are described where a heater is arranged adjacent to a pipe make/break vise assembly to heat a female tool joint of two pipe sections connected by threads to facilitate breaking or disconnection of the joint. The heater can have any configuration or can be used in any manner to result in even heating around the circumference of the female tool joint. In addition, the heater can be incorporated into the same apparatus as the make/break vise assembly, or the heater can be an apparatus that is separate from the apparatus containing the make/break vise assembly. In one embodiment, the heater can be used as a stand-alone heater to heat the female tool joint.

20 Claims, 10 Drawing Sheets

PIPE MAKE/BREAK VISE ASSEMBLY WITH PIPE JOINT HEATER

FIELD

This disclosure relates to a pipe make/break vise assembly for use in making up or breaking out pipe during assembly or disassembly of pipe. In particular, this disclosure relates to a heater that can be used with the pipe make/break vise assembly to heat a female joint of two pipe sections connected by threads to facilitate breaking of the joint.

BACKGROUND

It is known to connect two sections of pipe, for example drill pipe, casing, tubing, or other pipe, by threading a threaded male section (or male tool joint) of one pipe section into a threaded female section (or female tool joint) of the other pipe section. During connection of the pipe sections or during use of the pipe during drilling, the threaded connection may become over-torqued. If this occurs, breaking of the joint (i.e. initiating disconnection of the two pipe sections) may be difficult.

To facilitate breaking of an over-torqued joint, it is known to use a blow torch to heat the female tool joint. In this process, a worker holds the blow torch to heat a section of the female tool joint, and moves the blow torch around the circumference of the female tool joint in an effort to heat the entire diameter of the female tool joint. However, heating of the female tool joint using a blow torch is typically uneven, and uneven heating of the female tool joint can cause permanent warping of the female tool joint thereby rendering the pipe section containing the female tool joint unsuitable for use in assembling a new pipe.

SUMMARY

Systems, apparatus and methods are described where a heater is arranged adjacent to a pipe make/break vise assembly to heat a female tool joint of two pipe sections connected by threads to facilitate breaking or disconnection of the joint. The heater can have any configuration or can be used in any manner to result in even heating around the circumference of the female tool joint. In addition, the heater can be incorporated into the same apparatus as the make/break vise assembly, or the heater can be an apparatus that is separate from the apparatus containing the make/break vise assembly. When the heater is separate from the apparatus containing the make/break vise assembly, the heater may be configured to be manipulated by hand to properly position the heater relative to the female tool joint to heat the female tool joint during operation of the heater.

One apparatus described herein can include a make/break vise assembly having a stationary vise and a make/break vise, where the make/break vise is rotatable relative to the stationary vise, and a heater is mounted adjacent to the make/break vise assembly.

A system described herein can include a make/break vise assembly having a stationary vise and a make/break vise, where the make/break vise is rotatable relative to the stationary vise, and a heater is disposed adjacent to the make/break vise assembly.

A method of initiating breaking of a threaded male tool joint that is threaded into a threaded female tool joint in a pipe string includes heating the threaded female tool joint using a heater that is arranged adjacent to a make/break vise assembly having a stationary vise and a make/break vise, and initiating breaking of the male tool joint and the female tool joint by clamping the male tool joint and female joint using the make/break vise assembly and rotating the make/break vise relative to the stationary vise in a disconnect direction.

DRAWINGS

FIG. 1 schematically illustrates an embodiment of a system described herein.

FIG. 2 schematically illustrates another embodiment of a system described herein.

FIG. 3 schematically illustrates another embodiment of a system described herein.

FIG. 4 schematically illustrates another embodiment of a system described herein.

FIG. 5 schematically illustrates another embodiment of a system described herein.

FIGS. 6A and 6B illustrate one example of a heater described herein in an open configuration and a closed configuration, respectively.

FIGS. 6C and 6D each illustrate another example of a heater.

DETAILED DESCRIPTION

A heater is used together with a make/break vise assembly to facilitate breaking of an over-torqued joint between a threaded male tool joint and a threaded female tool joint. The heater is used to evenly heat the female tool joint substantially around the entire circumference of the female tool joint. This prevents warping of the female tool joint while facilitating subsequent breaking of the joint via the make/break vise assembly.

As used throughout this description and claims, the word pipe, unless otherwise specified, is intended to encompass drill pipe, casing, tubing, or other pipe designed to be connected by threads with other sections of pipe. The pipe is hollow. The pipe can be made of any type of material including, but not limited to, metal or plastic. The word pipe, unless otherwise indicated, is also intended to encompass pipe accessories including, but not limited to, a reamer/hole opener, a crossover sub/thread adaptor, a valve, or any other accessory that is connected by threads to a section of pipe. The concepts described herein can be used with any two pipe or pipe-related elements that are connected by threads and where one or more sections of the joint between the two elements may need to be heated to facilitate breaking or disconnection of the joint between the two threaded elements.

The pipes are described herein as having tool joints which are defined as enlarged and threaded ends of joints of drill pipe. However, the attachment can be used with pipe other than drill pipe, as long as the pipe is designed to connect to a section of pipe via rotation of the pipe.

Figure 1:
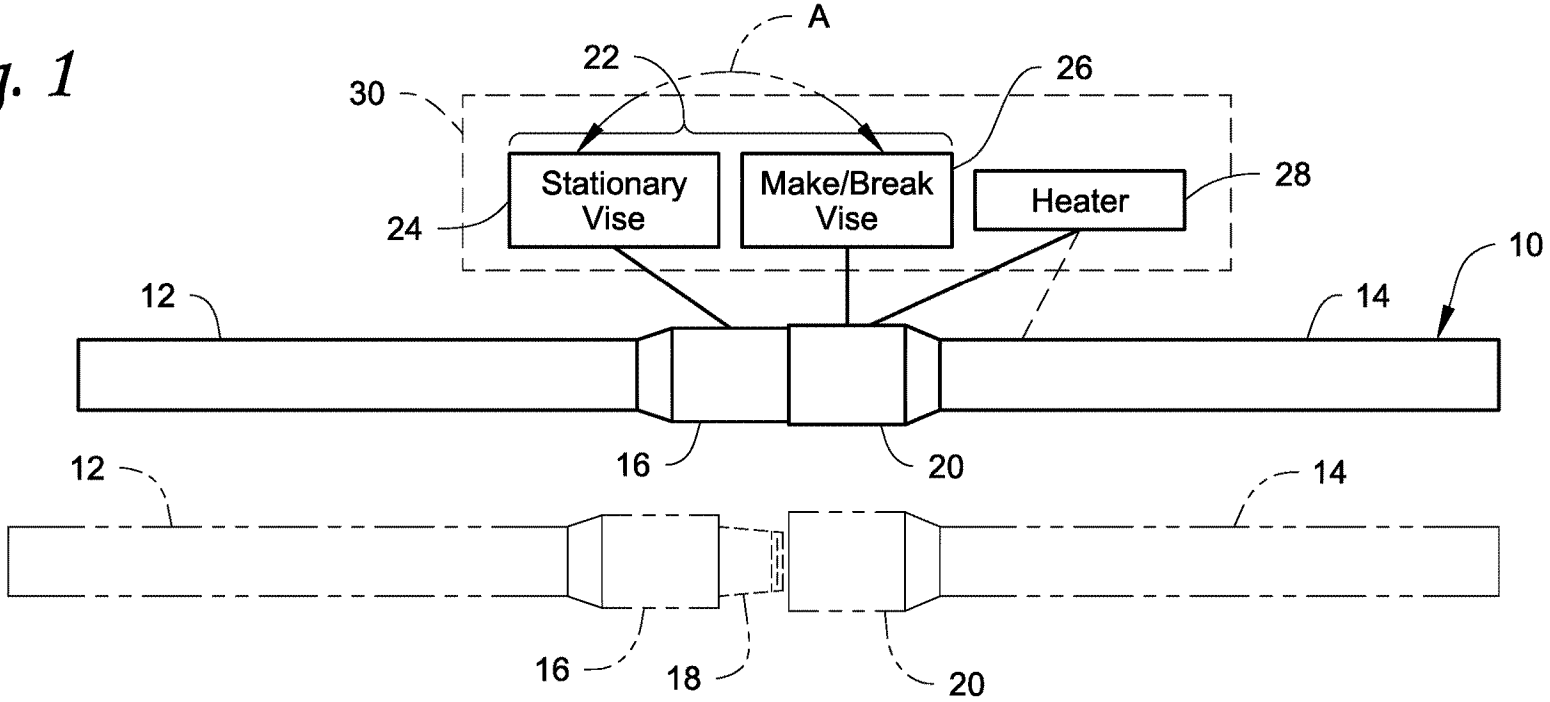

Referring initially to FIG. 1, a portion of a pipe string 10 is illustrated where a first pipe 12 is connected to a second pipe 14. The first pipe 12 has a male tool joint end 16 with a threaded male section 18. The second pipe 14 has a female tool joint end 20 with an interior thread designed to receive and be secured to the threaded male section 18. FIG. 1 shows the two pipes 12, 14 connected to one another and disconnected from one another. The construction of the pipes 12, 14 is well known in the art.

During connection of the two pipes 12, 14 or during use of the pipe string 10 during drilling, the joint between the male tool joint end 16 and the female tool joint end 20 may be over-torqued which can make disconnection (or breaking) of the joint difficult.

FIG. 1 shows a make/break vise assembly 22 that includes a stationary vise 24 and a make/break vise 26. In operation of the make/break vise assembly 22, the make/break vise 26 is rotatable relative to the stationary vise 24 to break the joint if the assembly 22 is used to disconnect the two pipes 12, 14 or to torque the joint if the assembly 22 is used to connect the two pipes 12, 14. The stationary vise 24 is configured to grip and hold the male tool joint end 16 while the make/break vise 26 is configured to grip and hold the female tool joint end 20. In operation, while the stationary vise 24 grips and holds the male tool joint end 16 and the make/break vise 26 grips and holds the female tool joint end 20, the stationary vise 24 and the make/break vise 26 rotate relative to one another about the longitudinal axes of the pipes 12, 14. For example, the make/break vise 26 can rotate relative to the stationary vise 24. The relative rotation between the stationary vise 24 and the make/break vise 26 initiates breaking or disconnection of the pipe 14 from the pipe 12. As indicated by the arrow A in FIG. 1, the positions of the stationary vise 24 and the make/break vise 26 may be reversed from that shown in FIG. 1, with the stationary vise 24 positioned to grip and hold the female tool joint end 20 while the make/break vise 26 positioned to grip and hold the male tool joint end 16.

The make/break vise assembly 22 can have any construction that is suitable for performing the functions of the make/break vise assembly 22 described herein. For example, the make/break vise assembly 22 can have a construction and operate as described in U.S. Patent Application Publication No. 2016/0160588 or in U.S. Pat. No. 8,490,519, each of which is incorporated by reference herein in its entirety. In addition, a suitable make/break vise assembly is available from LaValley Industries, LLC of Bemidji, Minn.

A heater 28 is arranged adjacent to the make/break vise assembly 22. The heater 28 is configured to heat the female tool joint end 20 prior to and/or during operation of the make/break vise assembly 22 to help initiate breaking of the joint. The heater 28 can be arranged to apply heat directly to the female tool joint end 20, or the heater 28 can be arranged to apply heat to another section of the pipe 14 which in turn results in indirectly heating the female tool joint end 20. The heater 28 can have any location and configuration that can result in sufficient heating of the female tool joint end 20 to facilitate breaking of the joint between the male tool joint end 18 and the female tool joint end 20.

The heater 28 can have any construction that is suitable for heating the female tool joint end 20. For example, the heater 28 can be an induction heater; a radiant heater; the heater can heat using one or more flames; the heater can heat using coils; or any other type of heating that achieves a desired level of heating to the female tool joint end 20.

In the example in FIG. 1, the make/break vise 26 is between the heater 28 and the stationary vise 24. In addition, the heater 28 and the make/break vise assembly 22 can be part of a common system or apparatus 30 illustrated in broken lines. The heater 28 can be part of the make/break vise assembly 22 or the heater 28 can be separate from the make/break vise assembly 22.

Figure 2:
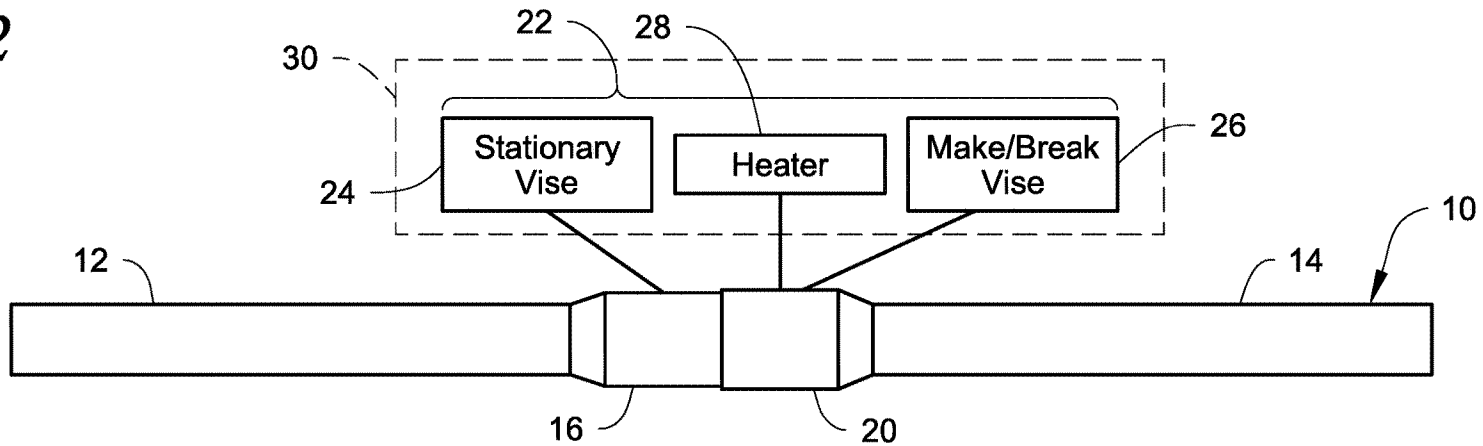

FIG. 2 illustrates an embodiment where the heater 28 is positioned between the stationary vise 24 and the make/break vise 26. The heater 28 and the make/break vise assembly 22 can be part of the common system or apparatus 30 illustrated in broken lines. In addition, the heater 28 can be part of the make/break vise assembly 22 or the heater 28 can be separate from the make/break vise assembly 22.

Figure 3:
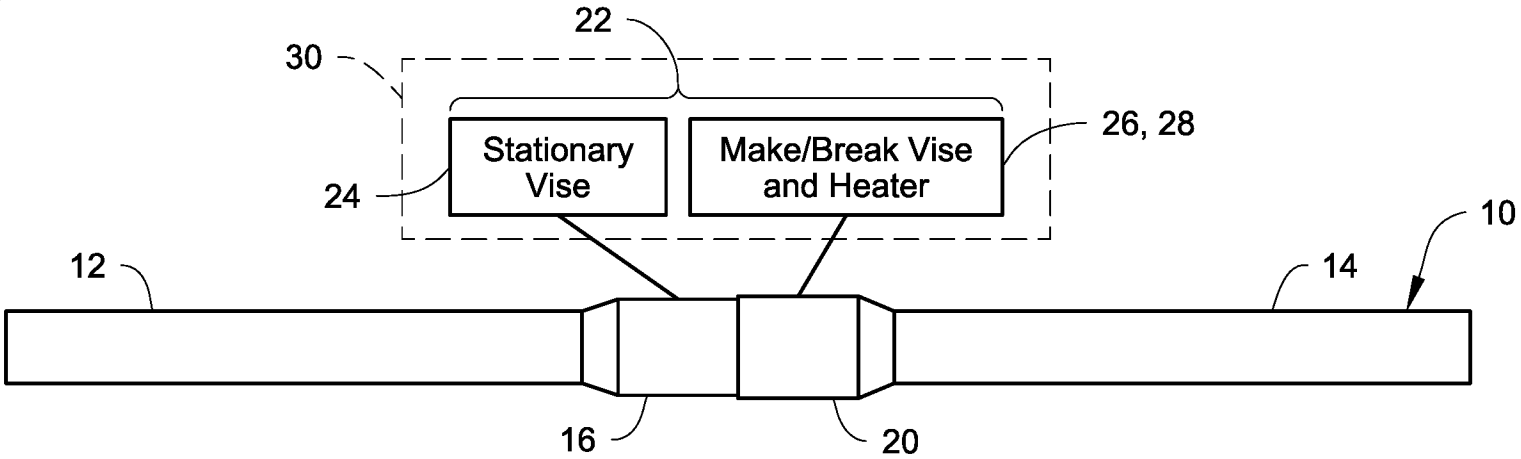

FIG. 3 illustrates an embodiment where the heater 28 is integrated into the make/break vise 26 (or the heater 28 can be integrated into the stationary vise 24). In this embodiment, the heater 28 and the make/break vise assembly 22 are part of the common system or apparatus 30 illustrated in broken lines.

Figure 4:
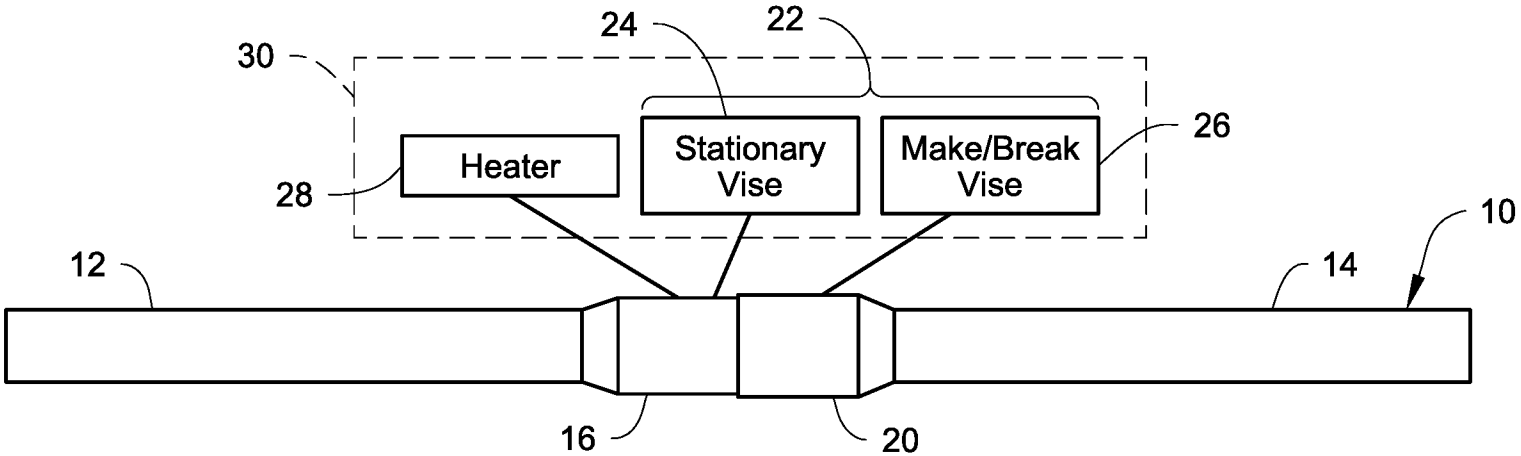

FIG. 4 illustrates an embodiment where the stationary vise 24 is positioned between the heater 28 and the make/break vise 26. The heater 28 and the make/break vise assembly 22 can be part of the common system or apparatus 30 illustrated in broken lines. The heater 28 can be part of the make/break vise assembly 22 or the heater 28 can be separate from the make/break vise assembly 22. In this embodiment, the heater 28 can be positioned to directly heat the male tool joint end 16 which in turn indirectly heats the female tool joint end 20.

Figure 5:
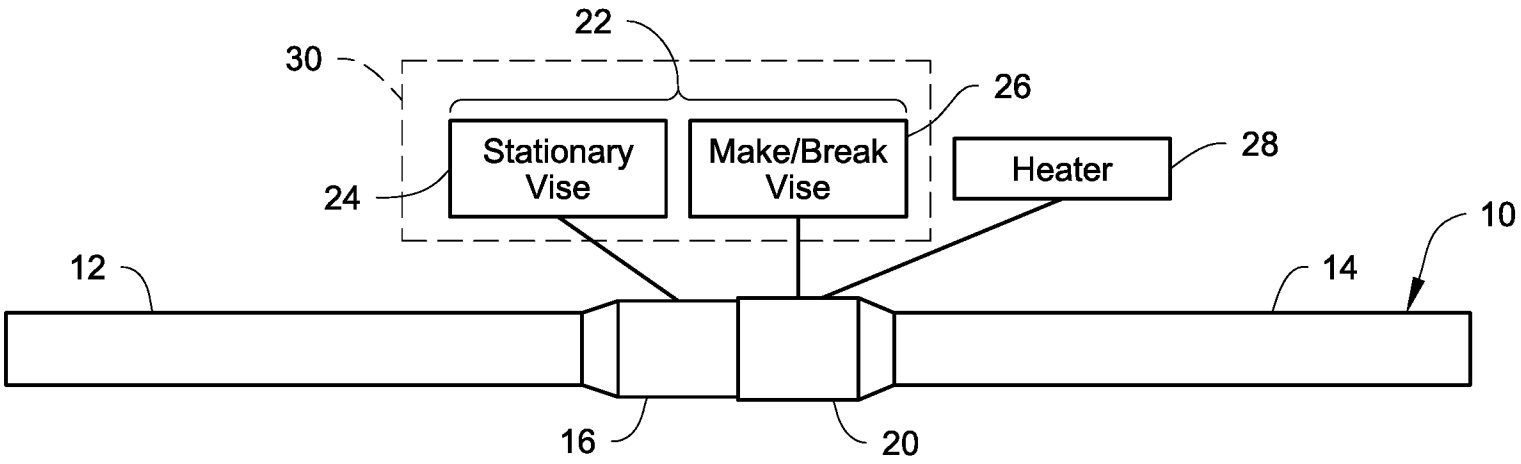

FIG. 5 illustrates an embodiment where the make/break vise 26 is between the heater 28 and the stationary vise 24. However, in this embodiment, the heater 28 is separate from the system or apparatus 30 that includes the make/break vise assembly 22.

Figure 6B:
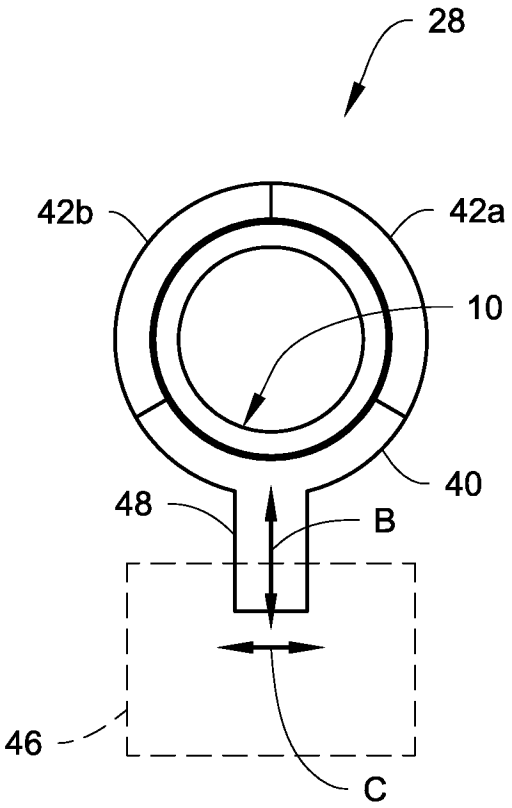
Figure 6A:
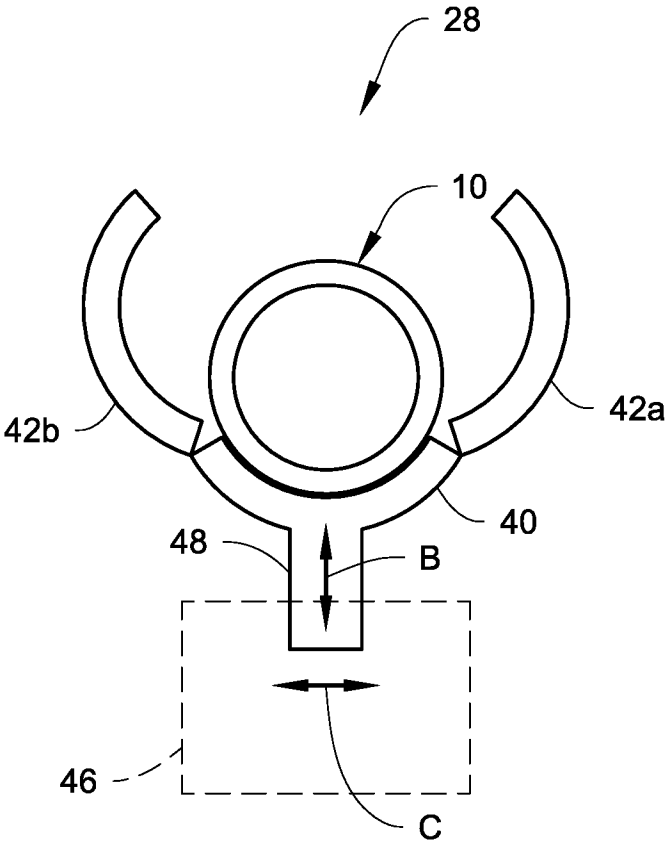

As indicated above, the heater 28 can have any construction that is suitable for heating the female tool joint end 20. FIGS. 6A and 6B illustrate one example of the heater 28. In this example, the heater 28 can be a ring-shaped induction heater that is configured to have a base section 40 and first and second arm sections 42*a*, 42*b*. The arm sections 42*a*, 42*b* are pivotally secured to the base section 40 so that the arm sections 42*a*, 42*b* can pivot between an open position (shown in FIG. 6A) and a closed position (shown in FIG. 6B). Suitable actuators, such as hydraulic cylinders, can extend between the arm sections 42*a*, 42*b* and the base section 40 to actuate the arm sections 42*a*, 42*b* opened and closed. At the open position, the heater 28 and the pipes of the pipe string 10 can be maneuvered into position relative to one another suitable for heating (directly or indirectly) the tool joint end 20. At the closed position, the base section 40 and the arm sections 42*a*, 42*b* can form a ring that substantially encircles the pipe string 10 to ensure substantially even heating of the entire circumference of the tool joint end 20. The even heating helps avoid warping of the tool joint end 20. In operation, electric current is passed through the base section 40 and the arm sections 42*a*, 42*b* which creates eddy currents in the tool joint end 20 (or other portion of the pipe string 10) causing the tool joint end 20 (or other portion of the pipe string 10) to heat up.

The base section 40 can be supported by a suitable support structure 46 via a support rod 48 that extends between the base section 40 and the support structure 46. The support structure 46 can be configured to actuate the support rod 48 so as to move the heater 28 toward and away from the tool joint end/pipe (as indicated by the arrow B) and/or shift the heater 28 side-to-side relative to the pipes 12, 14 (as indicated by the arrow C) and/or shift the heater axially or longitudinally parallel to the pipes 12, 14.

In FIGS. 6A and 6B, the heater 28 need not completely encircle the pipe string 10. Instead, the heater 28 can extend over only a portion of the circumference of the pipe string, in which case only those sections of the pipe string 10 that are located opposite the portions of the heater 28 have eddy currents created in them. However, the heat generated by the eddy currents is generally distributed evenly around the circumference of the pipe string 10, and heat that is generated in one circumferential section of the pipe string will be distributed via conduction to adjacent circumferential sections. In addition, the pipe string can be substantially stationary during operation of the heater 28. Alternatively, the pipe string 10 can be rotated about its longitudinal axis during operation of the heater 28.

Figure 6D:
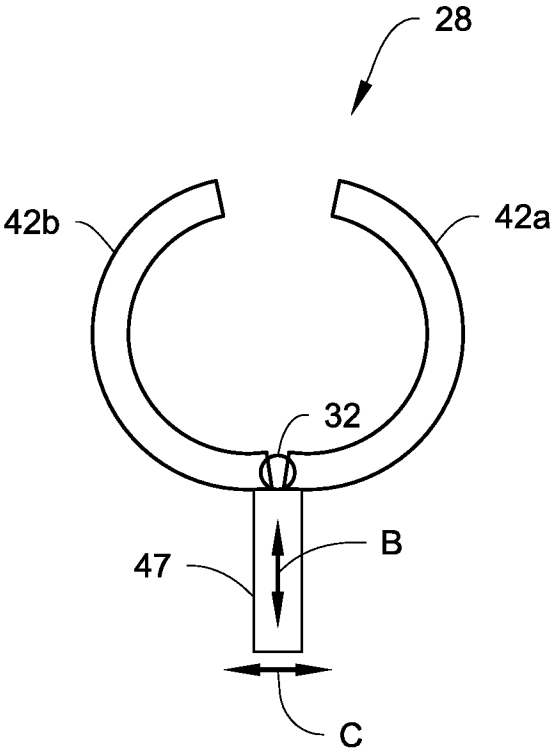
Figure 6C:
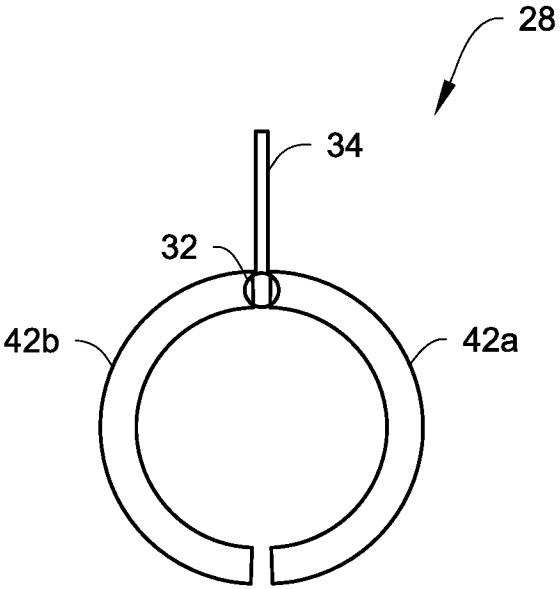

As shown in FIG. 6C, instead of the heater 28 being formed by the three sections 40, 42*a*, 42*b*, the heater 28 in FIG. 6C can be formed from two substantially 180 degree sections 42*a*, 42*b* that are hinged to one another by a hinge 32 to permit the heater 28 to open (one of the sections 42*a*, 42*b* can pivot relative to the other, or both of the sections 42*a*, 42*b* can pivot relative to each other) to allow installation around and removal from around the tool joint end or pipe, and close around the tool joint end or pipe. The heater 28 in FIG. 6C can be part of the system or apparatus 30 discussed above, or the heater 28 in FIG. 6C can be separate from the system or apparatus 30. For example, FIG. 6C illustrates the heater 28 as being suspended from a support structure 34 such as a cable. In this example, the heater 28 can be maneuvered by hand to position the heater 28 around the tool joint end as well as maneuvered by hand to remove the heater 28 from around the tool joint end or the pipe. One or more actuators (not shown) can be provided on the sections 42*a*, 42*b* to actuate the section(s) 42*a,b* open and closed.

FIG. 6D illustrates an embodiment of the heater 28 that is somewhat similar to FIG. 6C with like elements referenced using the same reference numerals. In this embodiment, the two 180 degree sections 42*a*, 42*b* are supported at their bottoms by the hinge 32 and define an upward facing opening to receive the tool joint end or pipe. In addition, the heater 28 is connected to a support structure 47 that can actuate the heater so as to move the heater 28 toward and away from the tool joint end/pipe (as indicated by the arrow B) and/or shift the heater 28 side-to-side relative to the pipes 12, 14 (as indicated by the arrow C) and/or shift the heater axially or longitudinally parallel to the pipes 12, 14

Figure 7:
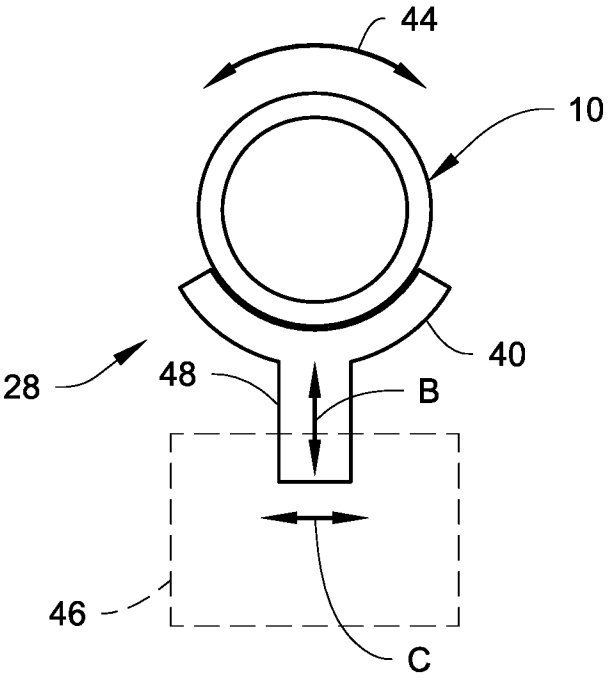
FIG. 7 illustrates another example of a heater described herein.

FIG. 7 illustrates another example of the heater 28. In this example, the heater 28 can be an induction heater having just the base section 40. In this embodiment, the pipe string 10 can be rotated (either in a clockwise direction or counterclockwise direction) about its longitudinal axis relative to the heater 28 as indicated by the arrow 44 during operation of the heater 28 so substantially even heating of the entire circumference of the tool joint end 20 is achieved. The base section 40 can be supported by the support structure 46 via the support rod 48 that extends between the base section 40 and the support structure 46. The support structure 46 can be configured to actuate the support rod 48 so as to move the base section 40 toward and away from the tool joint end/pipe (as indicated by the arrow B) and/or shift the base section 40 side-to-side relative to the pipes 12, 14 (as indicated by the arrow C) and/or shift the base section 40 axially or longitudinally parallel to the pipes 12, 14

Figure 8:
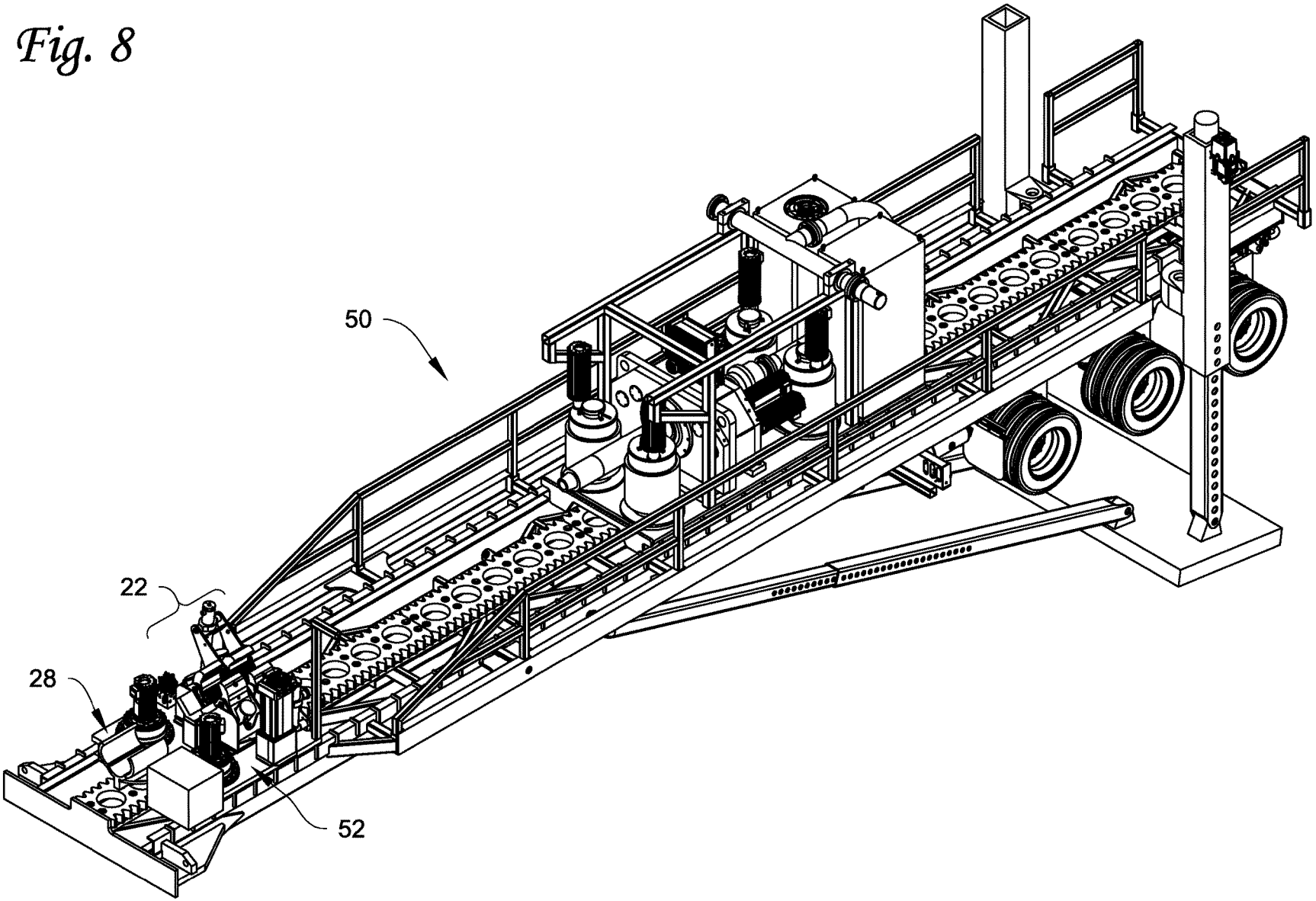
FIG. 8 illustrates one of the systems described herein incorporated into a horizontal directional drilling rig.
Figure 9:
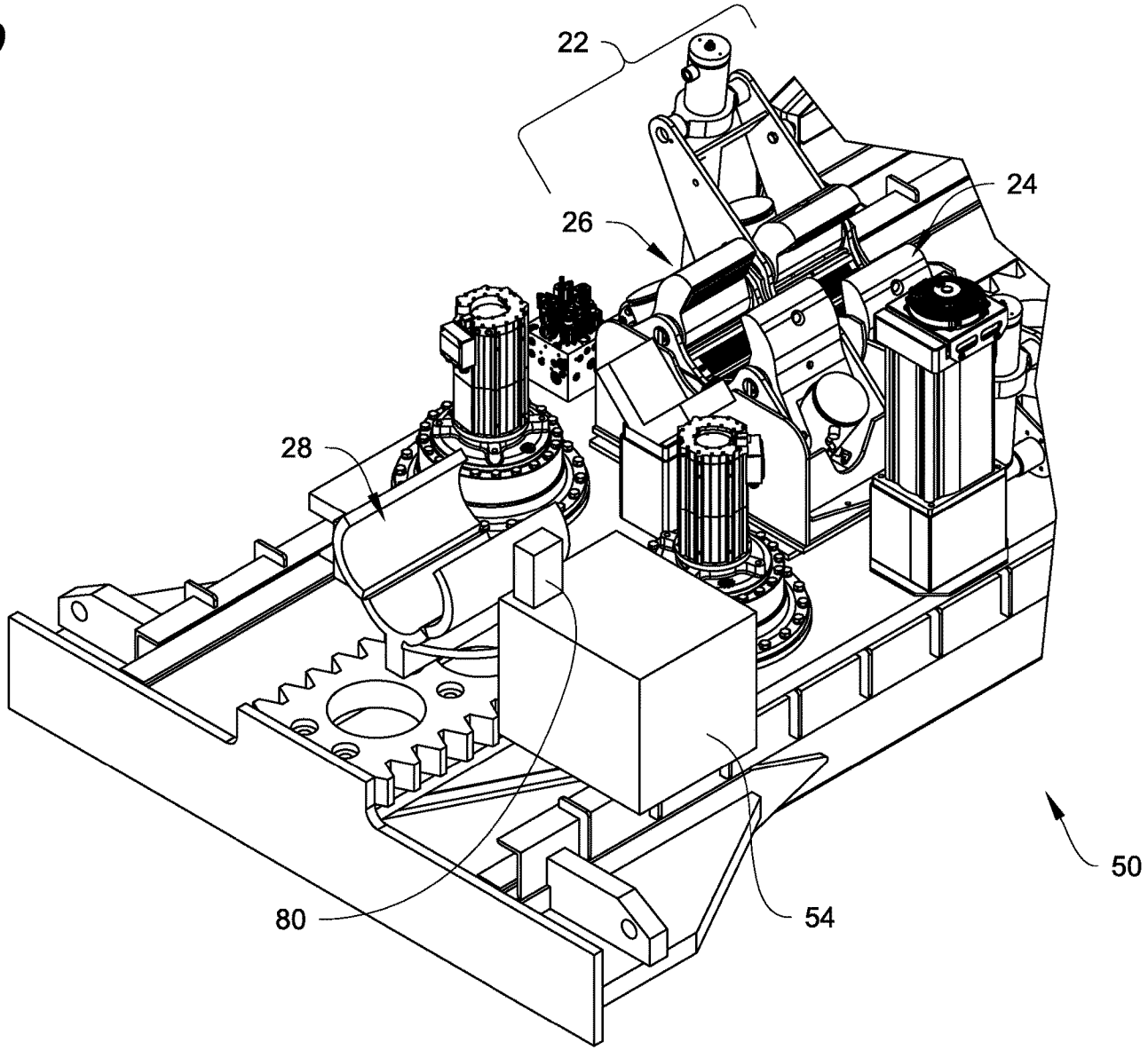
FIG. 9 is a close-up view of the heater and the make/break vise assembly in FIG. 8.

FIGS. 8 and 9 illustrate an example application of the systems described herein where the make/break vise assembly 22 and the heater 28 are used on a horizontal directional drilling (HDD) rig 50. The HDD rig 50 can have any construction that is capable of connecting and disconnecting drill pipe to form a pipe string, and can drive and retract the pipe string. One example of a suitable HDD rig 50 that can be used is described in U.S. application Ser. No. 15/605,324 filed on May 25, 2017 which is incorporated herein by reference in its entirety.

A vise carrier 52 is disposed at the front end of the HDD rig 50 and can move back and forth on the HDD rig 50 as described in U.S. application Ser. No. 15/605,324. The make/break vise assembly 22 and the heater 28 are mounted on the vise carrier 52. In this example, the heater 28 is shown as being located on the vise carrier 52 in front of the make/break vise assembly 22, with the make/break vise 26 located between the stationary vise 24 and the heater 28. Electrical energy for powering the heater 28 can be supplied from a power supply 54, for example located on the HDD rig 50 or off of the HDD rig 50. In this example, the heater 28 can have a construction that is similar to the construction described in FIGS. 6A and 6B, in FIG. 6C or in FIG. 6D.

Figure 10:
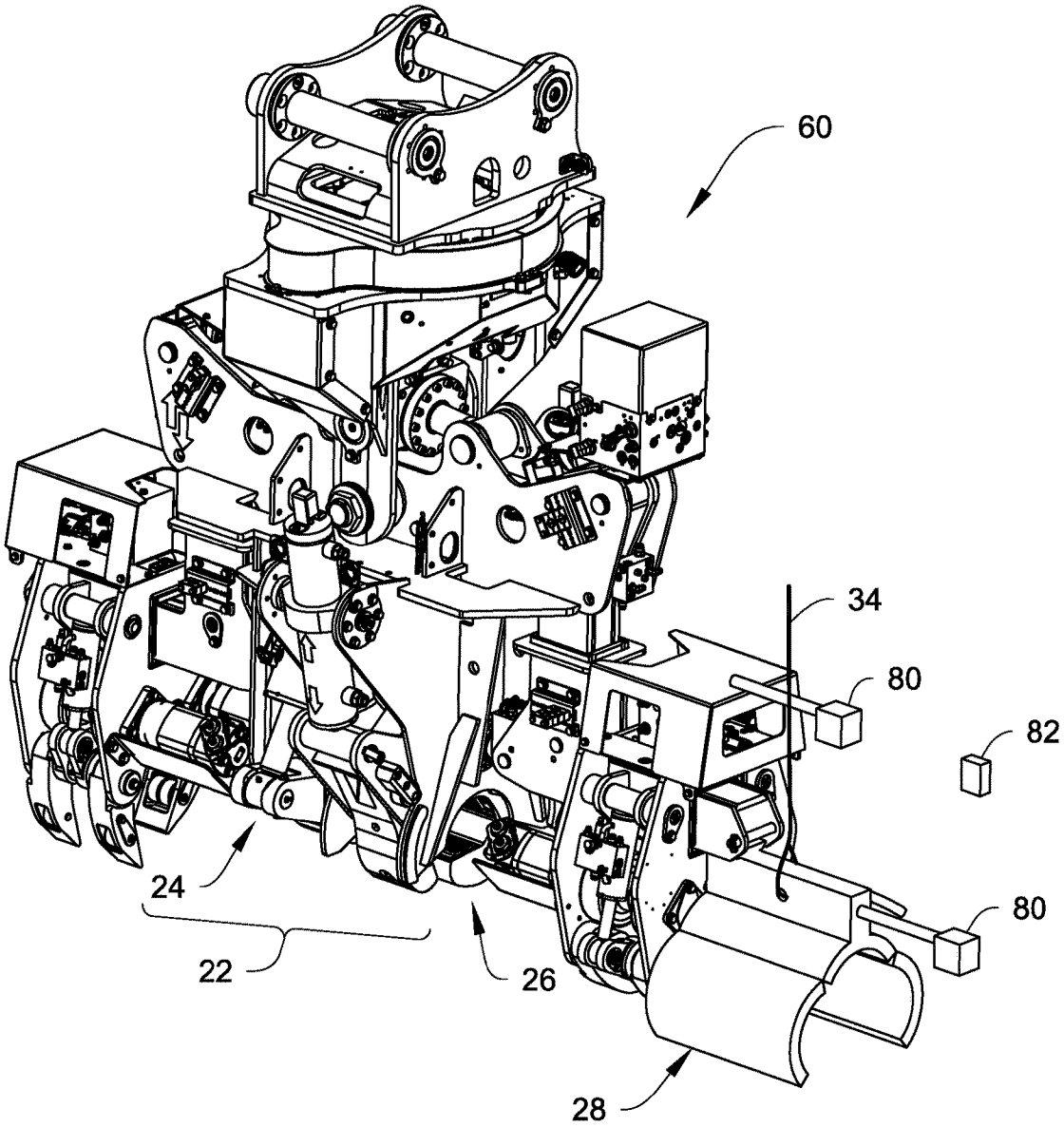
FIG. 10 illustrates one of the systems described herein incorporated into an attachment that is attachable to an end of an arm of an excavator.

FIG. 10 illustrates another example application of the systems described herein where the make/break vise assembly 22 and the heater 28 are used on an attachment 60 that is attachable to an end of an arm (not shown) of an excavator (not shown). The attachment 60 can have a construction and operation similar to that described in U.S. Pat. No. 8,490,519 and in U.S. Patent Application Publication No. 2016/0160588, each of which is incorporated herein by reference in its entirety. In this example, the heater 28 is shown as being located on the attachment 60 to one side of the make/break vise assembly 22, with the make/break vise 26 located between the stationary vise 24 and the heater 28. Electrical energy for powering the heater 28 can be supplied from a suitable power supply 54, for example located on the attachment 60 or off of the attachment 60. In this example, the heater 28 can have a construction that is similar to the construction described in FIGS. 6A and 6B. Rather than being located on or affixed to the attachment 60, the heater 28 can be suspended from the support structure 34, such as a cable, as described in FIG. 6C.

Figure 11:
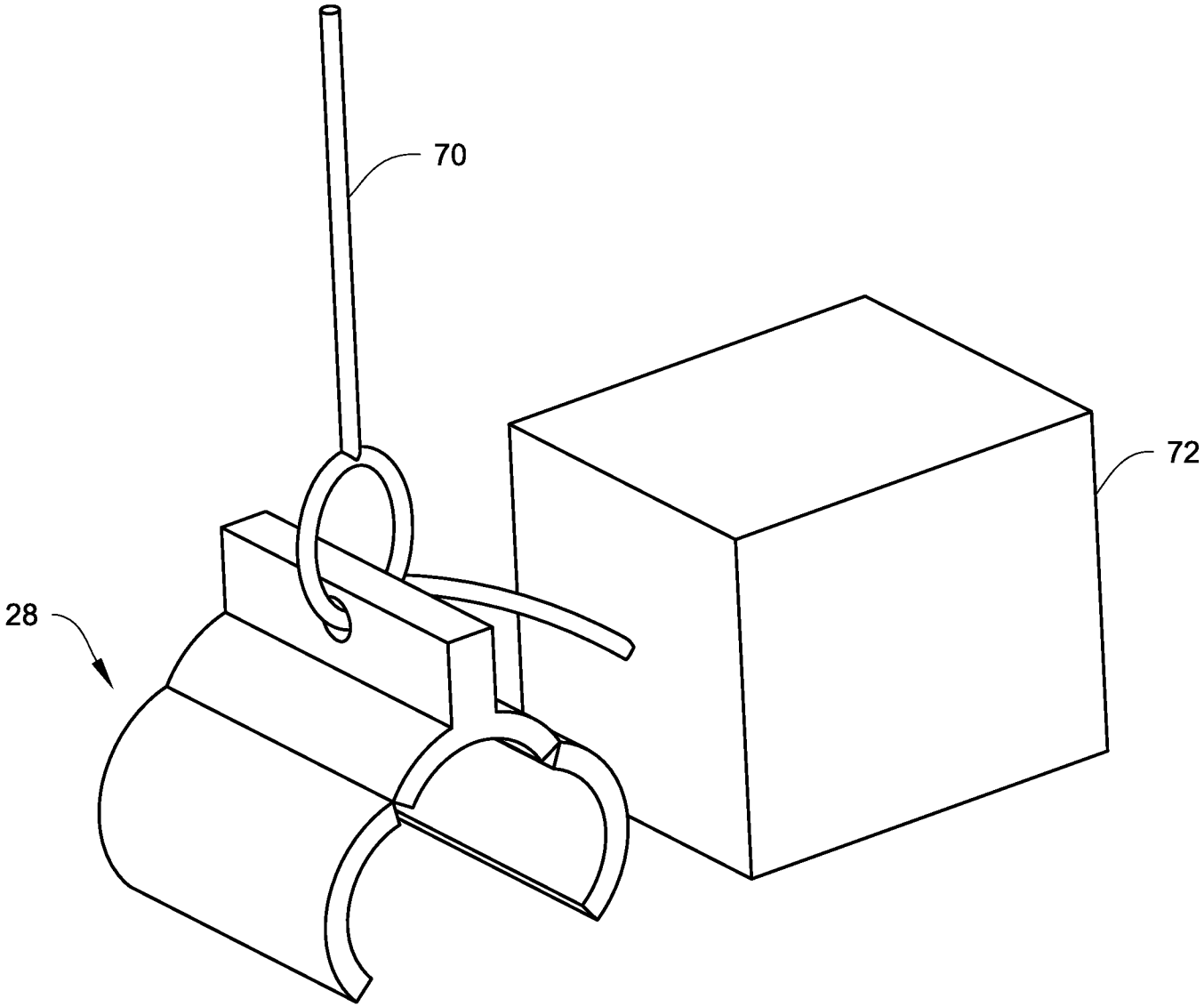
FIG. 11 illustrates another example of a heater described herein that is not mounted to the horizontal directional drilling rig of FIG. 8 or to the attachment of FIG. 10.

The heaters described herein are not limited to being used on or with a make/break vise, on or with HDD rig 50, or on or with the attachment 60. For example, FIG. 5 illustrates the heater 28 as being separate from the system or apparatus 30 that includes the make/break vise assembly 22. FIG. 11 illustrates one possible application where the heater 28 is a stand-alone unit separate from other structure, with the heater 28 being mobile to allow the heater 28 to be readily movable to any location where a tool joint has been over torqued and needs to be heated to facilitate breaking of the tool joint. In this embodiment, the heater 28 can be hand maneuvered while being suspended from a suitable suspension mechanism 70, such as one or more slings or cables. In an embodiment where the heater 28 is an induction heater, the heater 28 can be suitably connected to a source 72 of electricity.

In an embodiment, one or more heat detection sensors 80 can be provided to sense a heat profile of the female tool joint end 20. For example, the one or more heat detection sensors 80 can be located on the HDD rig 50 (see FIG. 9) or on the attachment 60 (see FIG. 10) at locations suitable for sensing the heat profile. In another embodiment, a worker can hold a hand-held heat detection sensor 82 (see FIG. 10) to sense the heat profile. The detected heat profile of the female tool joint end 20 can then be used to make determinations about the heating of the female tool joint end 20. For example, if the heat profile indicates that the female tool joint end 20 is heated sufficiently, the heater 28 can be turned off and the make/break vise assembly 22 can then be used to initiate breaking of the joint. If the heat profile indicates that the female tool joint end 20 is not heated sufficiently, the heater 28 can continue its operation or the heating by the heater 28 can be increased. If the heat profile indicates that the female tool joint end 20 is not evenly heated circumferentially, one or more sections of the heater 28 could be turned off, or one or more sections of the heater 28 could be actuated to increase their heating, in order to even out the circumferential heat profile of the female tool joint end 20.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method of initiating breaking of a threaded male tool joint that is threaded into a threaded female tool joint in a pipe string, the method comprising:

heating the threaded female tool joint using a heater that is arranged adjacent to a make/break vise assembly having a stationary vise and a make/break vise, wherein the heater and the make/break vise assembly are part of a common apparatus;

after heating the threaded female tool joint, actuating the heater to an open position, followed by repositioning the heater and the make/break vise assembly so that the make/break vise assembly is positioned relative to the male tool joint and the female tool joint to permit the make/break vise assembly to clamp the male tool joint and the female tool joint; and initiating breaking of the male tool joint and the female tool joint by clamping the male tool joint and female joint using the make/break vise assembly and rotating the make/break vise relative to the stationary vise in a disconnect direction.

2. The method of claim 1, comprising clamping the male tool joint using the stationary vise and clamping the female tool joint using the make/break vise.

3. The method of claim 1, comprising heating an entire circumference of the female tool joint.

4. The method of claim 1, comprising simultaneously applying heat to the entire circumference.

5. The method of claim 1, comprising applying heat to a section of the female tool joint while rotating the pipe string in order to heat the entire circumference of the female tool joint.

6. The method of claim 1, wherein the make/break vise is between the heater and the stationary vise.

7. The method of claim 1, wherein the heater is between the make/break vise and the stationary vise.

8. The method of claim 1, wherein the heater is integrated into the make/break vise or into the stationary vise.

9. The method of claim 1, wherein the stationary vise is between the heater and the make/break vise.

10. The method of claim 1, wherein the common apparatus comprises a horizontal directional drilling rig.

11. The method of claim 1, wherein the common apparatus comprises attachment that is attached to an end of an arm of an excavator.

12. An apparatus comprising:

a make/break vise assembly having a stationary vise and a make/break vise, the make/break vise is rotatable relative to the stationary vise; and a heater mounted adjacent to the make/break vise assembly, the heater is actuatable between an open position and a closed position; at the open position the heater can be installed around or removed from around a tool joint end or pipe, and at the closed position the heater can be closed around the tool joint end or the pipe.

13. The apparatus of claim 12, wherein the heater is an induction heater.

14. The apparatus of claim 12, wherein the apparatus is a horizontal directional drilling rig.

15. The apparatus of claim 12, wherein the apparatus is an attachment that is configured for attachment to an end of an arm of an excavator.

16. The apparatus of claim 12, wherein the make/break vise is between the heater and the stationary vise.

17. The apparatus of claim 12, wherein the heater is between the make/break vise and the stationary vise.

18. The apparatus of claim 12, wherein the heater is integrated into the make/break vise or into the stationary vise.

19. The apparatus of claim 12, wherein the stationary vise is between the heater and the make/break vise.

20. A method of initiating breaking of a threaded male tool joint that is threaded into a threaded female tool joint in a pipe string, the method comprising:

actuating an induction heater to an open position, positioning the induction heater relative to the pipe string, and actuating the induction heater to a closed position around the pipe string;

heating the threaded female tool joint using the induction heater; and thereafter initiating breaking of the male tool joint and the female tool joint by clamping the male tool joint and female joint using a make/break vise assembly having a stationary vise and a make/break vise and rotating the make/break vise relative to the stationary vise in a disconnect direction.

* * * * *